United States Patent [19]

Davis et al.

[11] Patent Number: 4,522,002

[45] Date of Patent: Jun. 11, 1985

[54] WALL PANELS

[76] Inventors: Wilfrid E. Davis, 1251 NW. 165th St., Miami, Fla. 33169; Richard A. Davis, 7301 Poinciana Ct., Miami Lakes, Fla. 33014

[21] Appl. No.: 504,618

[22] Filed: Jun. 15, 1983

Related U.S. Application Data

[63] Continuation-in-part of Ser. No. 422,642, Sep. 24, 1982, abandoned, which is a continuation-in-part of Ser. No. 378,629, May 17, 1982, abandoned.

[51] Int. Cl.[3] ..... E04D 1/00; E04D 3/363

[52] U.S. Cl. ..... 52/309.1; 52/314; 52/521; 52/536; 52/539; 52/747

[58] Field of Search ..... 52/314, 546, 521, 571, 52/553, 536, 539, 309.1, 741

[56] References Cited

U.S. PATENT DOCUMENTS

| | | | |
|---|---|---|---|
| 3,217,453 | 11/1965 | Medow | 52/314 |
| 3,621,625 | 11/1971 | Medow | 52/314 |
| 3,783,570 | 1/1974 | Storch | 52/553 |
| 4,070,843 | 1/1978 | Leggiere et al. | 52/521 |
| 4,102,106 | 7/1978 | Golder et al. | 52/553 |
| 4,223,490 | 9/1980 | Medow | 52/314 |

FOREIGN PATENT DOCUMENTS

| | | | |
|---|---|---|---|
| 2440497 | 11/1976 | Fed. Rep. of Germany | 52/314 |

*Primary Examiner*—Alfred C. Perham
*Attorney, Agent, or Firm*—Jack E. Dominik

[57] ABSTRACT

Disclosed is a constant contact panel interlock even during thermal expansion and contraction by providing flexible pins to bear on a tongue in a tongue and groove interlock and also by providing ramps for a bendable flange to slide over and bear on. Further, a material made of polypropylene with 20% calcium carbonate filler is used to form the panels, such material being sufficiently flexible at the temperatures common for panels exposed to direct sunlight (as on a roof or wall) to permit the pins or flange to bend without breaking and also being a material of much lower coefficient of expansion than pure polypropylene.

5 Claims, 7 Drawing Figures

WALL PANELS

CROSS REFERENCE TO RELATED APPLICATIONS

This application is a continuation-in-part of copending application Ser. No. 422,642 filed Sept. 24, 1982 now abandoned which is a continuation-in-part of application Ser. No. 378,629 filed May 17, 1982 and now abandoned.

BACKGROUND OF THE INVENTION

1. Field of the Invention

The present invention is directed to interlocking wall panels, and more specifically to a composition of matter and physical structures to enhance thermal stability and reduce rattling, warpage and buckling. The prior art is generally found in Class 52.

2. Description of the Prior Art

The prior art is exemplfiied by the following patents: U.S. Pat. Nos. 3,621,625; 3,783,570; 4,070,843; 4,102,106; 4,223,490 and West German Pat. No. 24 40 497. These previous patents have disclosed various methods of interlocking wall and roof panels. However, they have contributed little to the problems arising from thermal expansion and contraction after installation.

In particular, U.S. Pat. No. 4,223,490 discloses panels that interlock via a tongue and groove arrangement and that have breakable pins for preventing the tongue from fully penetrating the groove during installation. Overcoming the thermal expansion is a critical factor in the marketability of this product because the panels will expand as much as $\frac{5}{8}$ of an inch over the 40 inch length at temperatures of 160° F., which is easily attainable on hot sunny days. This expansion must be dealt with to prevent the panels from buckling away from the wall on which it is mounted. Then, upon thermal expansion after installation the expanding tongue breaks off the breakable pins and is able to penetrate farther into the groove, and upon contraction the tongue partially withdraws from the groove. This system of interlocking the panels, however, still has a problem of rattling due to the looseness of the tongue and groove joint. Also, the breakable nature of the pins may lead to a substantial number of the pins being broken off during shipment of the panels . This leads to misalignment of the panels upon installation and aggravates the rattling problem.

Similarly, U.S. Pat. No. 4,070,843 has a short tongue and a wide groove interlock, but primarily relies upon the nailing of the panels to the roof or wall for stability. No compensation for thermal expansion is really provided, and rattling due to the loose nature of the interlock is likely.

U.S. Pat. No. 3,073,570 provides a deep tongue and groove interlock, but fails to provide any expansion or contraction looseness so upon thermal expansion one would expect the panels to buckle.

The interlock of U.S. Pat. No. 4,102,106 is essentially a tongue and groove with the groove being the space between a panel and the supporting wall or roof. As with the previous patents, the tongue and groove interlock is loose, and also no compensation for thermal expansion or contraction is provided.

Lastly, West German Pat. No. 24 40 497 has an interlock similar to U.S. Pat. No. 4,102,106. And U.S. Pat. No. 3,621,625 has an interlock formed by again a tongue and groove but with the tongue wedging into the groove. However, no compensation for thermal expansion or contraction is provided, and thus one would anticipate buckling upon expansion and a loose interlock upon contraction resulting in rattling.

SUMMARY OF THE INVENTION

The present invention provides a constant contact panel interlock even during thermal expansion and contraction by providing flexible pins to bear on a tongue in a tongue and groove interlock and also by providing ramps for a bendable flange to slide over and bear on. Further, a material made of polypropylene with 20% calcium carbonate filler is used to form the panels, such material being sufficiently flexible at the temperatures common for panels exposed to direct sunlight (as on a roof or wall) to permit the pins or flange to bend without breaking and also being a material of much lower coefficient of expansion than pure polypropylene.

Thus the present invention solves the problem in the prior art by providing an interlock which allows for thermal expansion and contraction yet avoids looseness.

BRIEF DESCRIPTION OF THE DRAWINGS

Further objects and advantages of the present invention will become apparent as the following description of illustrative embodiments proceeds, taken in conjunction with the accompanying drawings, in which.

DESCRIPTION OF THE FIRST PREFERRED EMBODIMENT

Figure 1:
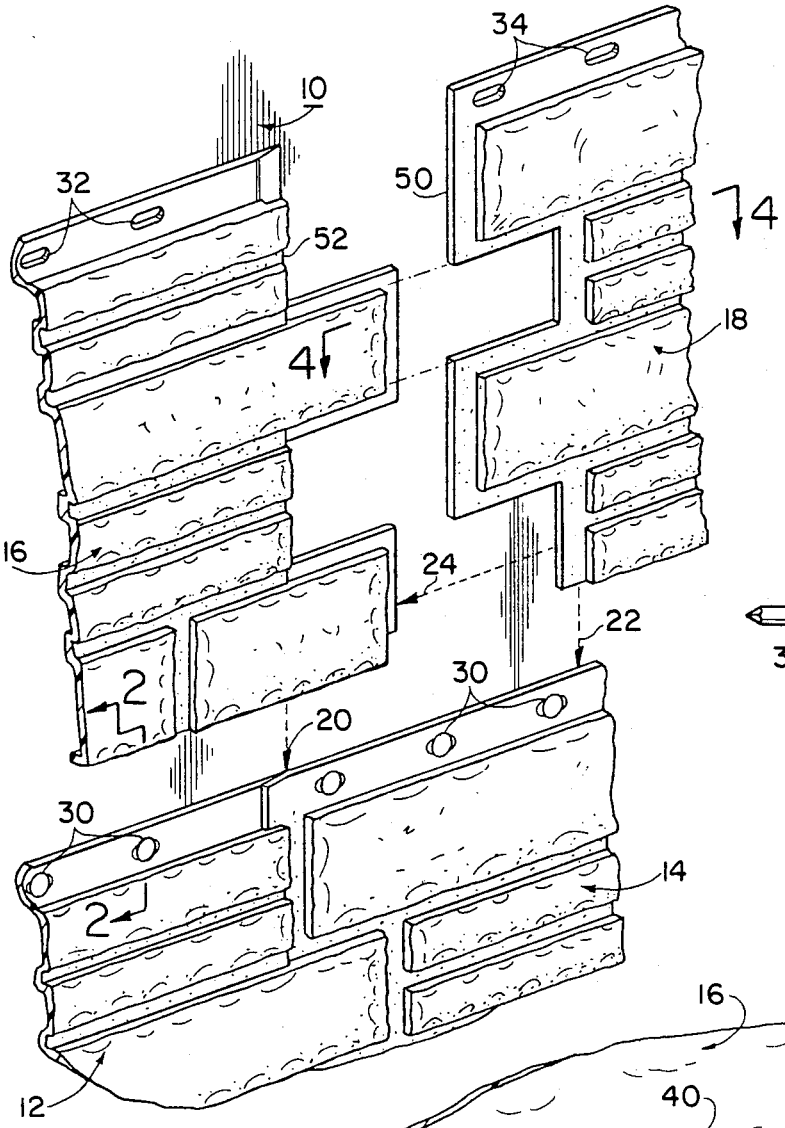
FIG. 1 is a perspective view of a typical wall including the subject panels, exploded to show the relationship between adjacent panels.

Referring to FIG. 1, a wall 10 is shown with panels 12 and 14 already nailed to wall 10 and panels 16 and 18 ready to be positioned to engage panels 12 and 14 and each other and to be nailed to wall 10. Arrow 20 shows the positioning of the panel 16 and arrows 22 and 24 shows the positioning of panel 18. Nails 30 (only the head visible in FIG. 1) driven through holes 31 (visible in FIGS. 2 and 3) secure panels 12 and 14 to wall 10, and after panels 16 and 18 are positioned nails will be driven through holes 32 in panel 16 and holes 34 in panel 18 to secure them to wall 10.

Figure 2:
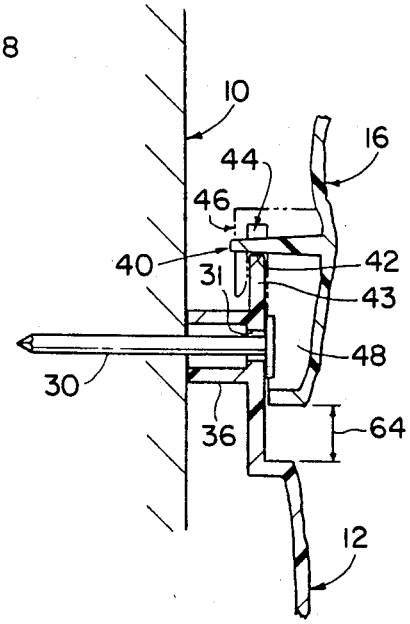
FIG. 2 is a transverse sectional view taken along section line 2—2 of FIG. 1 unexploded showing the flexible bendable pins in the relative panels.

FIG. 2 shows a cross-section of the engaging of panels 12 and 16 after panel 16 has been positioned in place and nailed to wall 10. Spacers 36 behind holes 31 insure that flange 43 is spaced from wall 10 after nailing.

Figure 3:
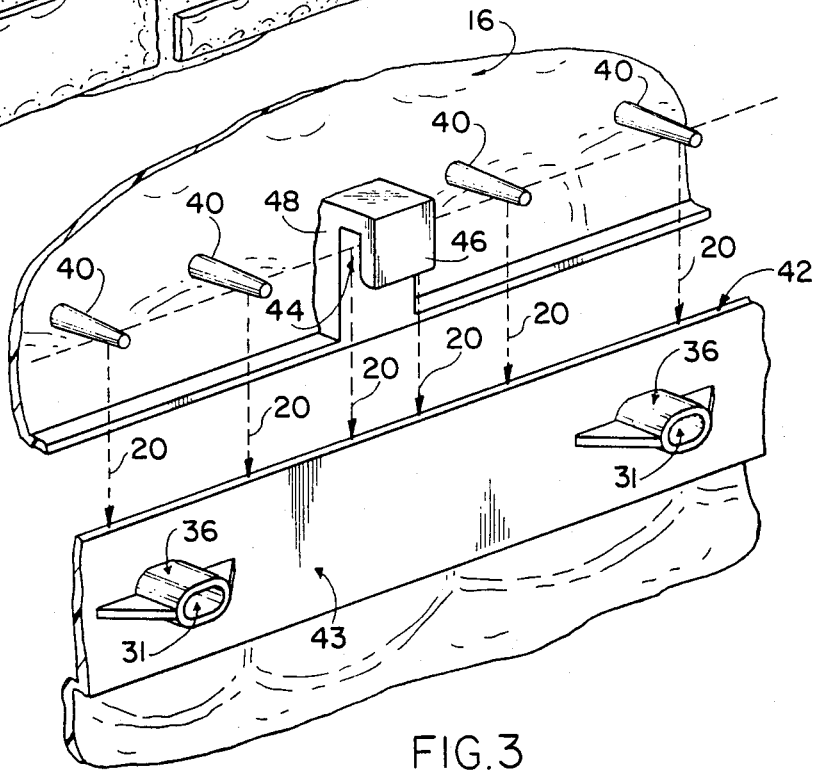
FIG. 3 is a fragmentary rear view of the exploded 2—2 section shown in FIG. 1.

The positioning of panel 16 to engage panel 12 is shown from the rear in FIG. 3 with wall 10 and nails 30 removed for clarity. Panel 16 is lowered as indicated by arrows 20 until flexible pins 40 abut the top edge 42 of flange 43 which forms the top portion of panel 12. In this position flange 43 partially fills slot 44 formed by flange 46 and base 48 on panel 16. The engagement of flange 43 in the slot 44 holds the bottom portion of the panel 16 next to wall 10 because flange 43 of panel 12 is nailed to wall 10 by nails 30. A large number of pins 40 eases installations. Using three flanges 46 and six pins 40 per foot of panel has proved convenient.

After panel 16 has been positioned in place by engaging flange 43 of panel 12, nails are driven through holes 32, thereby securing the top portion of panel 16 against wall 10. Thus it is seen that the upper and lower horizontal edge portions of panel 16 are held in a spaced relationship with wall 10. Further, the panel is provided with a plurality of spacers 49 (illustrated in FIG. 4) which keep the central portion of panel 16 spaced from wall 10.

Figure 4:
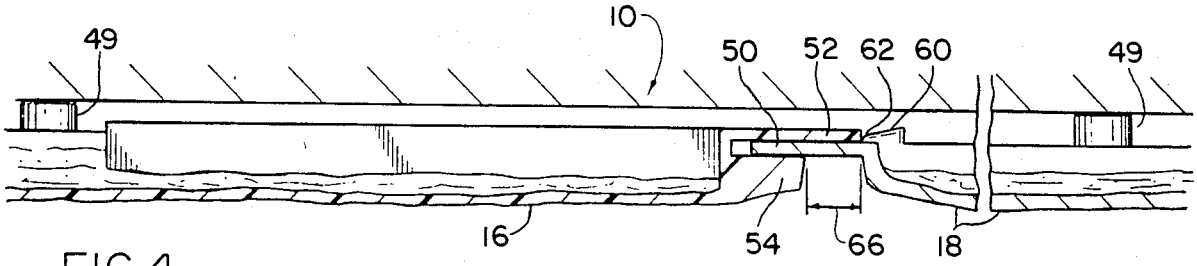
FIG. 4 is a sectional overhead view taken along section line 4—4 of FIG. 1 unexploded showing the ramps.
Figure 5:
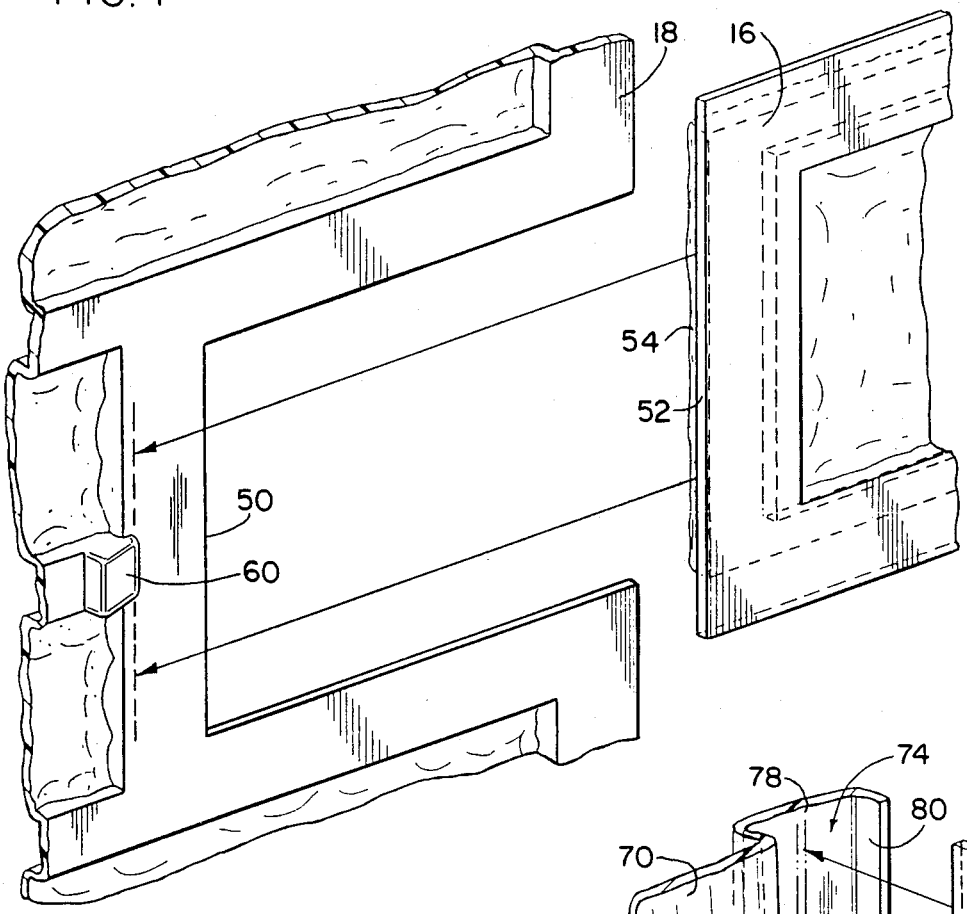
FIG. 5 is a rear elevation in enlarged scale of the section shown in FIG. 4.

The vertical ends of panels 16 and 18 form an engaging tongue and groove when panels 16 and 18 are positioned for nailing to wall 10. This is illustrated in FIGS. 4 and 5. FIG. 4 shows a cross-section of engaged panels 16 and 18 illustrating the flanges 52 and 54 of panel 16 which form the groove engaging the tongue. A ramp 60 is provided for installation depth guidance and expansion contact. During installation flange 50 is inserted into the groove formed by flanges 52 and 54 until ramp 60 abuts flange 52. Ramp 60 has a rounded top portion 62 which will permit flange 52 to bend and ride up on ramp 60 during thermal expansion and thereby insure frictional contact and eliminate looseness in the joint, as described below.

For a panel 16 of length approximately 40 inches and of height approximately 18 inches, the top flange 43 is approximately 1½ inches wide, flange 50 is approximately ¾ inches wide, flange 52 approximately 1 inch wide, flange 54 approximately ½ inch wide, and pins 40 approximately ½ inch long although these dimensions of the flanges are in part determined by the particular pattern molded on the panel 16. For example, if a brick or stone pattern is molded, then the portions of the flanges visible after installation on wall 10 (portion 64 in FIG. 2 and portion 66 in FIG. 4) are to simulate the mortar between the bricks or stones. Thus these visible portions 64 and 66 must have dimensions compatible with such simulation. Panel 16 is preferably of an 80% polypropylene 20% calcium carbonate composition and of a thickness of approximately 0.090 inches. Panels made of such a compound are quite flexible above 100° F., and thus permit flange 52 to bend and override ramp 60. Conversely, at installation temperatures the panels would be sufficiently rigid to resist overriding. During temperature changes panels 16 and 18 and all the other panels affixed to wall 10 will expand and contract; the primary effect is direct sunlight heating which typically raises the temperature of the panels from an abient of, say 60° F., to approximately 160° F.

In FIG. 4 it is seen that flange 50 will partially withdraw from the groove formed by flanges 52 and 54 upon a lowering of the temperature which causes a contraction of panels 16 and 18; whereas upon an increase in temperatures panels 16 and 18 will expand and flange 52 sill override ramp 60 due to its rounded top 62 and height. This overriding bends flange 52; thus flange 52 presses against ramp 60 and keeps the joint tight. If flange 50 reaches the end of the groove formed by flanges 52 and 54, then further expansion by panels 16 and 18 causes them to buckle or bow out from wall 10. To avoid this buckling or bowing, the panels 16 and 18 are preferably made from a composition of 80% polypropylene and 20% calcium carbonate. This composition reduces the total horizontal expansion of panel 16 to less than approximately ¼ inch over the temperature range 30° F. to 160° F. and thus prevents flange 50 from reaching the end of the groove formed by flanges 52 and 54 upon expansion and also prevent flange 50 from disengaging from the groove formed by flanges 52 and 54 upon contraction.

The effects of temperature changes for expansion and contraction in the vertical direction are compensated for by pin 40 as follows. During installation panel 16 is lowered onto panel 12 so that flange 43 engages slot 44, and as shown in FIGS. 2 and 3 this engagement is limited by flange 43 abutting and slightly bending pins 40. With an increase in temperature panel 16 expands toward panel 12 and pins 40 bend so slot 44 may move down on flange 43. Upon a decrease in temperature panel 16 will contracts upwards in FIG. 2 and flange 43 partially disengage slot 44. Pins 40 remains in contact with flange 43 except during low temperatures and thus provides tightness in the joint and eliminate any rattling of panel 16 about flange 43.

DESCRIPTION OF THE SECOND PREFERRED EMBODIMENT

Figure 6:
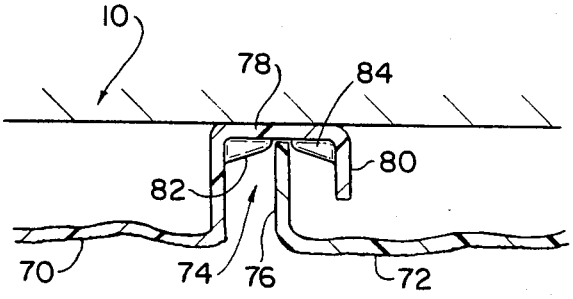
FIG. 6 is a sectional overhead view of the second preferred embodiment corresponding to FIG. 4.
Figure 7:
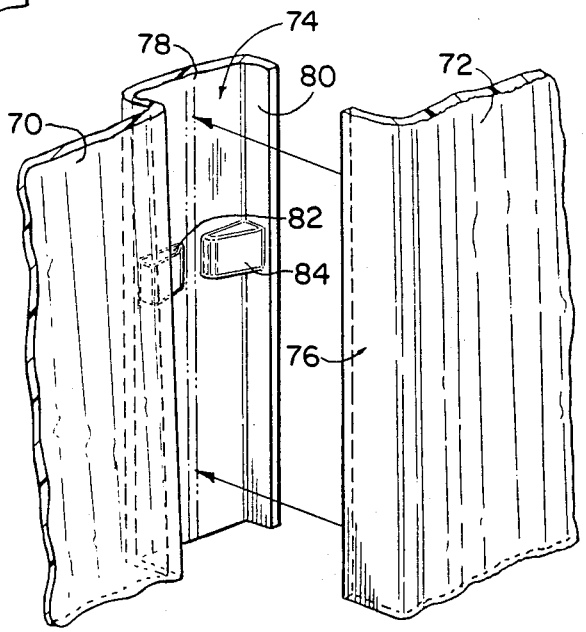
FIG. 7 is a fragmentary front view of the second preferred embodiment corresponding to FIG. 3.

For panels molded with patterns of shingles the vertical ends differ from panels molded with patterns of stone or brick because of the vertical continuity of shingle patterns as opposed to the primarily horizontal continuity of brick and stone patterns. Thus an alternative to the tongue and groove formed by flange 50 of panel 18 and flanges 52 and 54 of panel 16 is the channel 74 in panel 70 and engage flange 76 of panel 72 as shown in FIGS. 6 and 7. FIG. 6 is a cross-sectional view. Channel 74 is formed by flange 78 and depending flange 80 in the vertical end of panel 70. Panel 72 is positioned to engage panel 70 by centering flange 76 in channel 74. To center flange 76 a pair of ramps 82 and 84 are formed in channel 74 with a space between them of approximately the thickness of flange 76. Upon installation panels 70 and 72 are positioned against the immediately adjacent panel below (this is analogous to panels 16 and 18 being adjacent against panels 12 and 14 in the first preferred embodiment) and flange 76 of panel 72 is positioned in the gap between ramps 82 and 84. Panel 70 is nailed to wall 10 prior to panel 72 being nailed to wall 10.

Upon changes in temperature the panels 70 and 72 expand and contract with the following results. Upon an increase in temperature, the panels 70 and 72 expand towards each other and flange 76 rides up and over ramp 82 because projection 82 is rounded and of a height measured from the bottom of channel 74 of approximately 0.080 inches. The thickness of the panels 70 and 72 is approximately 0.090 inches throughout. Upon a decrease in climatic temperature, panels 70 and 72 contract away from each other, and flange 76 rides over ramp 84.

The horizontal edges of panels 70 and 72 are similar to those of panels 16 and 18, that is the lower edge of panel 70 has flanges analogous to flange 46 forming slots analogous to slot 44 which engage an upper flange analogous to flange 43 on the immediately adjacent panel below.

Panels 70 and 72 are essentially the same size as panels 16 and 18, that is 18 inches high and approximately 40 inches long. Channel 74 is approximately ¾ inches wide, and the width of flange 76 varies because of the slope of the molded shingle pattern. Use of a composition of 80% polypropylene and 20% calcium carbonate results in a panel of temperature change expansion and contraction which is small enough to permit flange 76 to remain in channel 74. If pure polypropylene is used, then flange 76 will likely be forced against one or the other sides of channel 74 upon expansion and contraction.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification and appended claims.

What is claimed is:

1. A panel body for covering a wall, comprising:

(a) a thin, generally rectangular body having top and bottom horizontal edge regions and left and right vertical edge portions, (b) said top region having a plurality of holes for receiving nails for affixing said panel to said wall; and (c) said bottom region having a plurality of upwardly recessed projecting flanges forming with said panel body a plurality of slots and a plurality of projecting bendable pins, said slots dimensioned and oriented to engage the top region of a second body, and said pins located so that;

(i) said second panel body top region may partially engage said slots while abutting said pins, and (ii) said second panel body top region may fully engage said slots only when said pins contain an upward bend.

2. The panel body of claim 1 wherein:

(a) said right vertical region having a plurality of grooves, said grooves dimensioned and oriented to engage the left vertical region of a second panel body, and (b) said left vertical region of said second panel body having a plurality of ramps dimensioned and located so that:

(i) said second panel body having a left vertical region may partially engage grooves of said right vertical region while said ramps of said left vertical region of said second panel body abut said right region, and (ii) said second left vertical region may fully engage said grooves only by bending groove walls over said ramps, and (iii) said ramps are spaced away from said wall when said second body is nailed to said wall.

3. The panel of claim 1, wherein said panel is composed of the following:

polypropylene: 70–90% by weight calcium carbonate: 10–30% by weight.

4. A method for engaging laterally a panel body for covering a wall, comprising (a) a generally rectangular, thin panel body having top and bottom horizontal edge regions and left and right vertical edge regions, (b) said right vertical region having a plurality of grooves, said grooves dimensioned and oriented to engage the left vertical region of a second panel body, and (c) said left vertical region of said second panel body having a plurality of ramps dimensioned and located so that:

(i) said left vertical region of said second panel body may partially engage said grooves while its said ramps abut said right vertical region, and (ii) said left vertical region of said second panel body may fully engage said grooves only by bending outwardly the walls of said grooves thereby riding them up and over said ramps of said left vertical region of said second panel body.

5. The panel of claim 4, wherein said panel is composed of the following:

polypropylene: 70–90% by weight calcium carbonate: 10–30% by weight.

* * * * *